United States Patent [19]

Tanaka

[11] 4,216,176

[45] Aug. 5, 1980

[54] HUMIDIFIER

[76] Inventor: Hajimu Tanaka, 54-1-814, Mukogaoka 1-chome,, Toyonaka-shi, Osaka, Japan

[21] Appl. No.: 955,954

[22] Filed: Oct. 30, 1978

[30] Foreign Application Priority Data

Aug. 9, 1978 [JP] Japan ..... 53-097676
Aug. 9, 1978 [JP] Japan ..... 53-109961[U]

[51] Int. Cl.[2] ..... B01F 3/04

[52] U.S. Cl. ..... 261/142; 219/274; 239/136; 261/104; 261/154

[58] Field of Search ..... 219/274; 239/136; 422/305; 261/142, 154, 104

[56] References Cited

U.S. PATENT DOCUMENTS

| | | | |
|---|---|---|---|
| 1,144,508 | 6/1915 | Taylor, Jr. | 239/136 |
| 1,403,548 | 1/1922 | Gudeman | 239/136 |
| 1,522,755 | 1/1925 | Soreng et al. | 219/274 |
| 1,535,287 | 4/1925 | Beeler | 219/274 |
| 1,732,674 | 10/1929 | Dever | 219/274 |
| 1,994,331 | 3/1935 | Ziskin et al. | 219/274 |
| 2,124,543 | 7/1938 | Clyne | 219/274 |
| 2,424,268 | 7/1947 | Delano | 219/274 |
| 3,080,624 | 3/1963 | Weber | 261/154 |

FOREIGN PATENT DOCUMENTS

| | | | |
|---|---|---|---|
| 511931 | 4/1955 | Canada | 422/305 |

*Primary Examiner*—Tim R. Miles
*Attorney, Agent, or Firm*—Whittemore, Hulbert & Belknap

[57] ABSTRACT

A humidifier comprising an electric lamp, a protector in the form of a dome-shaped member surrounding the glass bulb of the electric lamp, an evaporation layer made of capillary substance closely contacted with the outer surface of the protector to cover the same, and a water-holding saucer for immersing a portion of the evaporation layer in water or a tightly closed tank having a water supply port at the lower end thereof which communicates with the outer surface of the evaporation layer in sealed relation to the outside. By making the protector of light transmitting material, the humidifier can be used also as an all-night light. The evaporation layer is surrounded with an ornamental cover having water vapor outlets.

3 Claims, 3 Drawing Figures

HUMIDIFIER

The present invention relates to a humidifier and particularly to a humidifier designed to evaporate water by heat energy emitted from an electric lamp.

Generally, humidifiers are provided with a supersonic wave generator, centrifugal sprayer or other expensive equipment, posing a problem in point of cost.

A principal object of the invention is to provide a humidifier which is very simple in arrangement and inexpensive, not requiring an expensive supersonic wave generator or the like.

Another object of the invention is to provide a humidifier using an electric lamp, wherein water in an evaporation layer made of capillary substance disposed around said electric lamp is evaporated by heat energy emitted from said electric lamp. The term "electric lamp" used herein is intended to mean an incandecent lamp, infrared lamp or any other source which emits light and radiant heat energy.

A further object of the invention is to provide a humidifier, wherein a protector in the form of a dome-shaped member interposed between said electric lamp and evaporation layer is made of light-transmitting material, so that the humidifier can be used also as an all-night light.

Another object of the invention is to provide a humidifier, wherein said evaporation layer is surrounded with an ornamental cover having water vapor outles.

Another object of the invention is to provide a humidifier, wherein a portion of said evaporation layer is immersed in water and as a means for supplying water to the evaporation layer a tightly closed tank is used which is disposed above the evaporation layer and which has a water supply port at the lower end thereof communicating with the outer surface of the evaporation layer in sealed relation to the outside, so that even if the humidifier topples over, there is no possibility of the water spilling.

These and other numerous features and merits of the invention will be readily understood from the following description of preferred embodiments of the invention to be given with reference to the accompanying drawings, in which.

Figure 1:
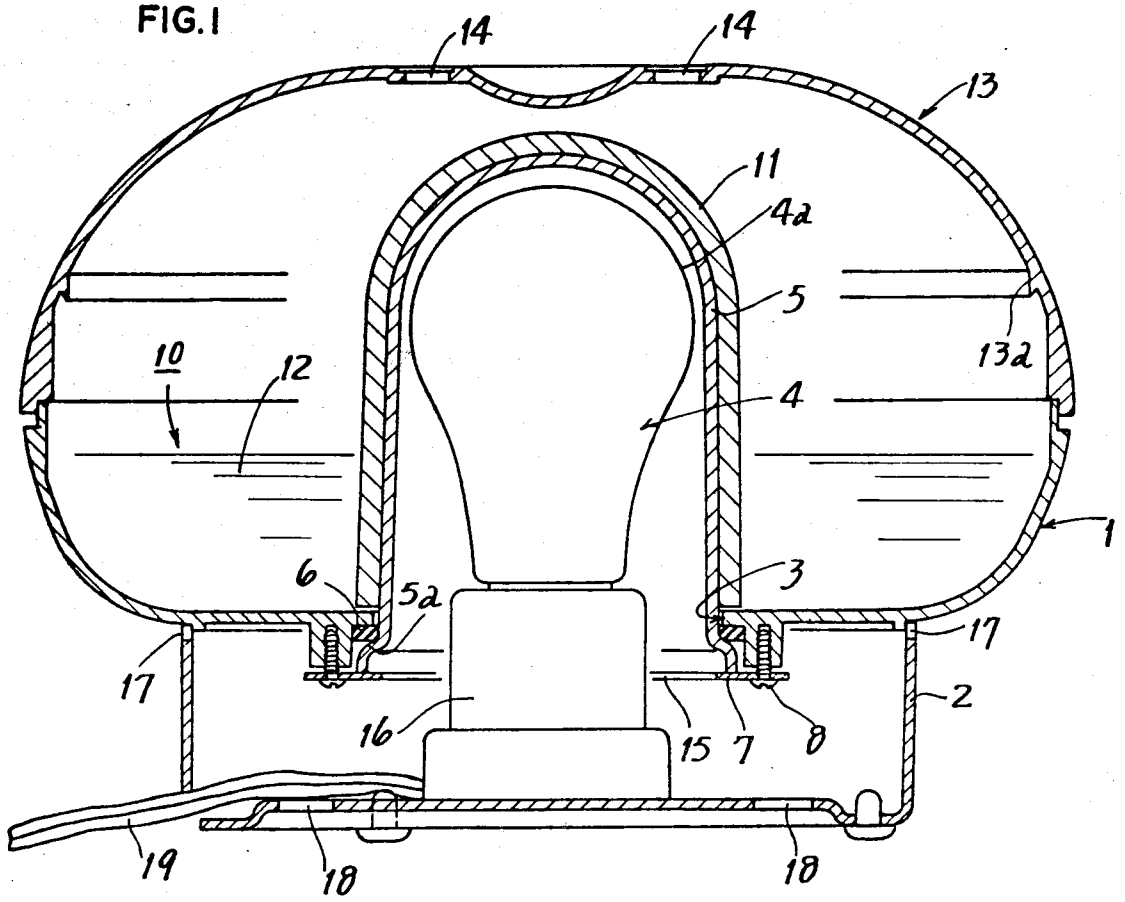
FIG. 1 is a complete front view, in longitudinal section, of a humidifier according to a first embodiment of the invention.
Figure 2:
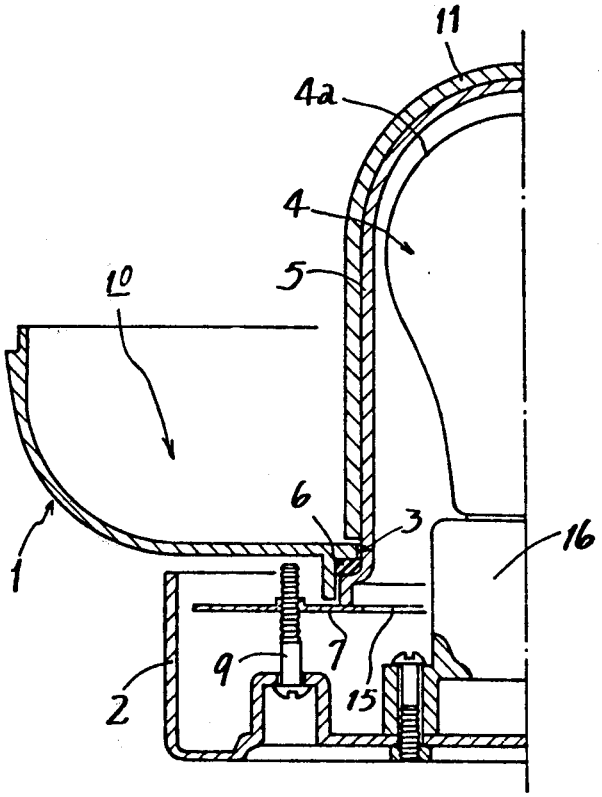
FIG. 2 is a fragmentary view in longitudinal section, with the plane of section displaced from that of FIG. 1 through a suitable angle around the center axis, the lid structure being removed.

Referring to FIGS. 1 and 2, the numeral 1 designates a saucer attached to the top of an attaching frame 2, said saucer 1 being formed with a circular hole 3 at the middle of the bottom wall. The numeral 4 designates an incandecent lamp attached to the middle of said attaching frame 2, with the glass bulb 4*a* of said lamp 4 projecting upwardly through the hole 3 of said saucer 1.

The numeral 5 designates a dome-shaped protector made of heat-resistant glass, having a lower open end portion projecting downwardly through the hole 3 of said saucer 1 to a position below the bottom wall of the saucer, the portion of said protector above said lower end portion being positioned above the bottom wall of the saucer, covering the glass bulb of the lamp 4 with a suitable spacing therebetween. The protector 5 has a larger diameter portion with a shoulder 5*a*. A packing 6 abuts against the front surface of said shoulder 5*a* and also against the periphery of the hole 3 of the bottom wall of the saucer.

The numeral 7 designates a protector holding plate abutting against the lower end surface of said protector 5. By fastening said holding plate 7 to the bottom wall of the saucer with screws 8, the protector and the saucer 1 are fixed together and, at the same time, the packing 6 interposed between the shoulder 5*a* of the protector 5 and the lower surface of the bottom wall of the saucer is compressed, whereby the sealed state between the saucer 1 and the protector 5 is maintained. The upper end edge of said attaching frame 2 and the bottom wall of said saucer 1 abut against each other and, as shown in FIG. 2, screws 9 whose necks are engaged with the bottom of said attaching frame 2 extend through said holding plate 7 for threaded engagement therewith, so that by turning the screws 9 for screwing into the holding plate 7, the attaching frame 2 and the saucer 1 are fixed together. The numeral 10 designates an annular water reservoir section which is formed in the saucer 1 around said protector 5.

The numeral 11 designates an evaporation layer made of capillary substance, e.g., glass fiber cloth, closely contacted with the outer surface of the protector 5 to cover the same. The lower end of the evaporation layer 11 is immersed in the water 12 in the water reservoir section 10 to supply water to the entire surface of the evaporation layer 11. In addition to glass fiber cloth, other kinds of cloth which have satisfactory water absorbing power may be used for the evaporation layer.

The numeral 13 designates a lid structure which covers the top of the saucer 1 and is formed with vapor discharging holes 14 adjacent the middle thereof. The lid structure 13 is constructed to be supported on the saucer 1 by having its lower end fitted on the upper end of the saucer 1. Therefore, there is a danger that the condensate moving down on the inner surface of the lid structure 13 will flow out through the region of engagement between the lid structure 13 and the saucer 1. In order to prevent this, a projection 13*a* is provided on the inner surface of the lid structure 13 adjacent the lower end thereof for returning the condensate to the saucer 1. The numeral 15 designates a hole formed in said holding plate 7 at the middle thereof for receiving a receptacle 16 which is used to attach said electric lamp 4, there being a clearance defined between the hole 15 and the receptacle 16 for heat dissipation. The numerals 17 and 18 designate cutouts and holes formed in the upper end and bottom of the attaching frame 2, respectively, for heat dissipation. The numeral 19 designates a power cord for feeding the electric lamp 4.

While the vapor discharge holes 14 have been shown as formed in the lid structure 13 only adjacent the middle thereof in the illustrated embodiment, additional holes may be provided radially around said holes 14.

In order to humidify the air in the room by this humidifier, the electric lamp 4 is lighted. Then, the evaporation layer 11 will be heated by heat emitted from the electric lamp 4 through the protector 5, so that the water contained therein will evaporate to produce vapor. As much water as evaporated is automatically supplied to the evaporation layer 11 from the water reservoir section 10. The vapor leaves the humidifier through holes 14 to humidify the air in the room.

In this humidifier, if a perfume is put in the water 12 in the water reservoir section 10, fragrance will be given out during humidifying operation. Further, if an insecticide liquid is added to the water 12, this liquid will be vaporized for discharge into the room to kill mosquitoes, etc. in the room. It is also possible to put both said perfume and said insecticide liquid in the water 12.

Further, since the humidifier is equipped with the protector 5 which covers the electric lamp 4 and which is sealed between its open end and the saucer 1, safety is assured even if the humidifier topples over, with no possibility of the water touching the electric lamp 4.

Further, by making both said saucer 1 and said lid structure 13 or at least said lid structure of light-transmitting synthetic resin and by making the protector 5 of light-transmitting substance, the light emitted from the electric lamp 4 can be admitted into the room through the protector, evaporation layer and lid structure. Thus, the device can be used as an all-night light as well as a humidifier. Means (not shown) may be provided for adjusting the size of said holes 14 so as to adjust the intensity of illumination.

Figure 3:
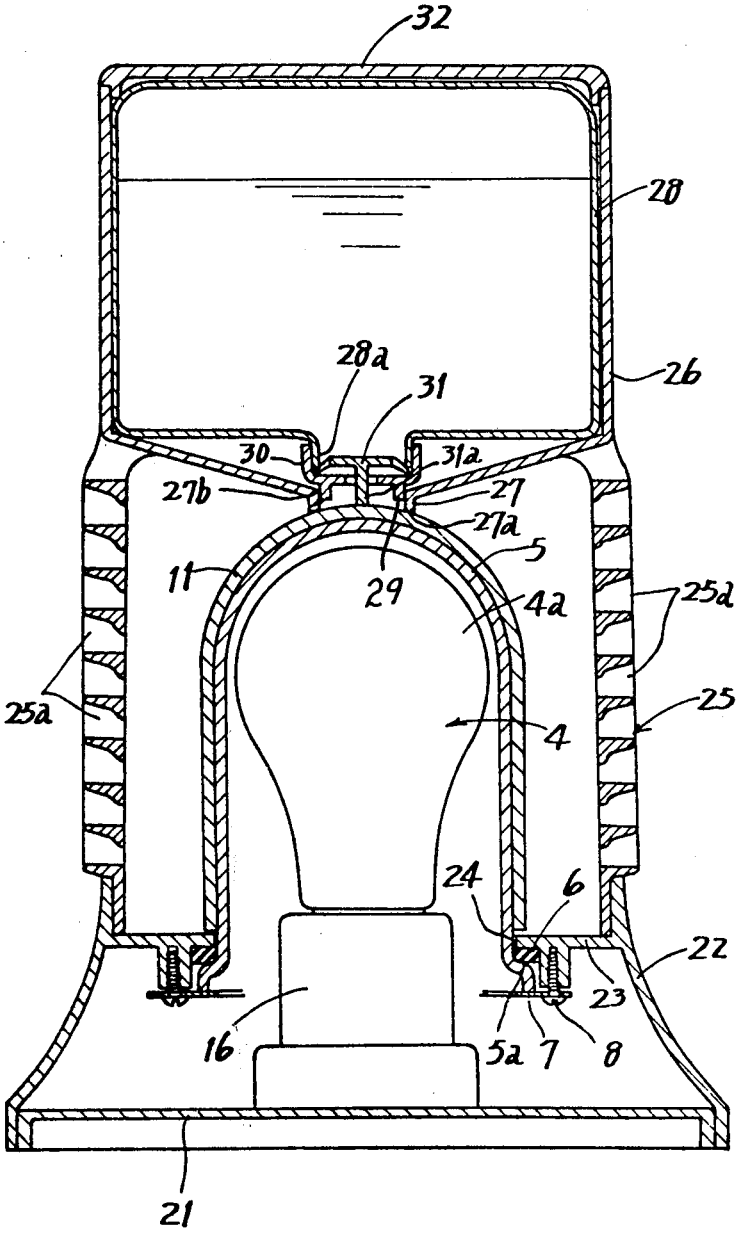
FIG. 3 is a complete front view, in longitudinal section, of a second embodiment of the invention.

Another embodiment of the invention will now be described with reference to FIG. 3. In addition, the parts which are substantially the same as those shown in FIGS. 1 and 2 are designated by like reference characters and a description thereof is omitted. In FIG. 3, the numeral 21 designates a pedestal on which the receptacle 16 is fixed. The numeral 22 designates an annular attaching frame extending upwardly from the outer periphery of the pedestal 21 to surround the receptacle 16, said attaching frame having a horizontal plate portion 23 extending from adjacent the upper end to the center thereof, said horizontal plate portion 23 being centrally formed with a hole 24 corresponding to the hole 3 in the first embodiment.

The numeral 25 designates a cylindrical louver of synthetic resin whose lower end is fitted in the upper end of said attaching frame 22 and which surrounds the evaporation layer 11 and is provided with a number of vapor discharging openings 25*a* arranged vertically and circumferentially. The cylindrical louver may, of course, be replaced by a cylindrical member having a number of vapor discharging outlets. Provided on the upper end of the cylindrical louver 25 is a tank housing 26 which is integral with or removable from said louver.

The middle of the lower end of the housing 26 is provided with a cylindrical port member 27 whose lower open end 27*a* is closely contacted with the outer surface of the upper end of the evaporation layer 11. A tightly close tank 28 having a single water supply port 29 is received in the housing 26 in such a manner that said water supply port 29 is fitted in the upper opening 27*b* in the cylindrical port member 27 in sealed relation to the outside. The term "tightly closed tank" as used herein is intended to means that the tank has no other openings, such as air inlet ports, which establish communication between the interior and exterior of the tank in the above mentioned received state, than the water supply port 29, not that the tank has not any tightly closable opening for filling the tank with water before it is received. In the illustrated embodiment, the water supply port 29 is formed on an automatic tap assembly 30 which has a valve 31 and which is secured on port 28*a* of the tightly closed tank 28 as by being screwed thereon. The automatic tap assembly 30 is so arranged that normally it is closed and that when the tightly closed tank 28 is received in the tank housing 26, the projection 31*a* on the valve 31 abuts against the outer surface of the evaporation layer 11 to cause the valve 31 to be pushed up, thereby opening the tap. The construction of the tap is shown only schematically, with particulars thereof omitted. The numeral 32 designates a removable lid for the upper end opening in the tank housing.

In operation, when the tightly closed tank 28 with water put therein is received in the tank housing as illustrated, the water in the tank flows out toward the evaporation layer 11 through the water supply port 29. The water which flowed out penetrates the evaporation layer 11 from top to bottom, but it will not flow out of the evaporation layer 11 because of the surface tension of water. Ultimately, the evaporation layer 11 is thoroughly permeated with water. In this state, the open end 27*a* of the port member 27 communicating with the water supply port 29 in the sealed state is tightly closed by the water which has penetrated the evaporation layer 11 at the top thereof, so that there is no possibility of additional water flowing out of the tightly closed tank 28.

When the electric lamp 4 is lighted, the radiant heat therefrom evaporates the water in the evaporation layer 11 and the vapor generated discharges into the room through the openings 25*a* in the louver 25. As the water contained in the evaporation layer 11 decreases, the seal between the outer surface of the upper end of the evaporation layer 11 and the open end 27*a* of the port member 27 is disestablished, allowing additional water to flow out of the tightly closed tank 28 toward the evaporation layer 11 while the corresponding amount of air enters the tightly closed tank 28 from between the outer surface of the evaporation layer and the open end 27*a*. In this way, the evaporation layer 11 is automatically replenished with water from the tightly closed tank 28 depending upon the amount of water evaporated.

With this humidifier, since the water is held in the tightly closed tank, it will not spill from the tank even if the humidifier topples over by accident.

In addition, although the tightly closed tank may be supported in such a manner as to bring the water supply port 29 into direct close contact with the outer surface of the upper end of the evaporation layer 11 without providing the port member 27, the provision of the port member will cause no damage to the evaporation layer 11, thus assuring a stabilized operation lasting for a long time.

I claim:

1. A humidifier comprising; an electric lamp, a protector in the form of a dome-shaped member made of heat resistant and light-transmitting material which surrounds the glass bulb of said electric lamp with a spacing therebetween and which has a lower open end provided with a large diameter portion with shoulder, an evaporation layer made of capillary substance in close contact with the outer surface of said protector to cover the same, an annual saucer which is capable of holding water and which has an opening at the middle of the bottom wall thereof through which the protector passes, a seal packing abutting against the shoulder of the protector and the lower surface of the bottom wall of the saucer at the periphery of the opening, pressing means for pressing the open end of the protector to the bottom wall of the saucer, and an ornamental cover provided with a vapor outlet and mounted on the saucer and covering the evaporation layer.

2. A humidifier as set forth in claim 1, wherein said protector is made of heat-resistant glass.

3. A humidifier as set forth in claim 1, wherein said evaporation layer is formed of glass fiber cloth.

* * * * *